US005281019A

United States Patent [19]

Rodeck

[11] Patent Number: 5,281,019

[45] Date of Patent: Jan. 25, 1994

[54] FOLDABLE PLAN STAND CASE

[76] Inventor: John Rodeck, 138 Thiersant, St. Louis, Richelieu County, Quebec, Canada, J0G 1K0

[21] Appl. No.: 916,739

[22] Filed: Jul. 22, 1992

[51] Int. Cl.[5] ..... A47B 95/02

[52] U.S. Cl. ..... 312/244; 190/11; 248/461

[58] Field of Search ..... 248/164, 461, 188, 188.5, 248/172; 190/11, 900; 108/157; 312/231, 244

[56] References Cited

U.S. PATENT DOCUMENTS

| | | | |
|---|---|---|---|
| 1,762,580 | 6/1930 | Menk | 190/11 X |
| 1,770,156 | 7/1930 | Hoyer | 190/11 X |
| 3,669,227 | 6/1972 | Alford | 248/461 X |
| 3,952,989 | 4/1976 | Hatcher | 248/444.1 X |
| 4,360,183 | 11/1982 | Biasini | 248/444.1 X |
| 4,372,630 | 2/1983 | Fuhri | 312/231 |
| 4,451,728 | 5/1984 | McKay | 312/244 X |
| 5,115,893 | 5/1992 | Terkildsen | 190/11 |

FOREIGN PATENT DOCUMENTS

| | | | |
|---|---|---|---|
| 2008208 | 1/1990 | Canada . | |
| 228050 | 11/1910 | Fed. Rep. of Germany | 248/164 |

OTHER PUBLICATIONS

Advertising Brochure Rodeck Innovations, Nov. 1991.

*Primary Examiner*—J. Franklin Foss

*Attorney, Agent, or Firm*—Edwin E. Greigg; Ronald E. Greigg

[57] ABSTRACT

The case comprises two plan supporting sheet members, and a hinge pivotally connecting the sheet members together, such that the sheet members and the hinge form a substantially flat surface when the sheet members are pivoted to be in line with one another and in an open position. Detachable legs for supporting the sheet members in the open position are also provided, and the legs are stored by the case when the legs are detached and the sheet members are closed up.

17 Claims, 5 Drawing Sheets

FOLDABLE PLAN STAND CASE

FIELD OF THE INVENTION

The present invention relates to a foldable plan stand case which folds open to provide a substantially flat surface for supporting a building plan, a blueprint or the like in which detachable leg means are provided for supporting the case when open.

BACKGROUND OF THE INVENTION

In the construction industry, building plans are consulted on a regular basis as the building construction is being completed. The plans are usually rolled up for ease of carrying to and from the construction site. In order to consult the building plans, the plans are either rolled out on a floor of the building under construction using various paper weights to prevent the plans from rolling back up, or a makeshift table is used on which the building plans can be placed at a reasonable height, and various objects serving as paper weights are used to prevent the plans from rolling up.

In the conventional way of transporting and consulting building plans, there is a tendency for the building plans to become torn, dirtied or damaged by exposure to the elements.

SUMMARY OF THE INVENTION

The present invention provides a foldable plan stand case which eliminates the above-mentioned drawbacks associated with consulting building plans on a construction site.

In accordance with the invention, there is provided a foldable plan stand case comprising two plan supporting sheet members, hinge means pivotally connecting the sheet members together, such that the sheet members and the hinge means form a substantially flat surface when the sheet members are pivoted to be in line with one another and in an open position, detachable leg means for supporting the sheet members in the open position, and means for storing the leg means when the leg means are detached and the sheet members are closed up.

Preferably, the leg means are collapsible and the leg means may comprise a pair of rectangular tubular members inset one inside the other and being pivotally joined to form an X-shaped stand. The tubular rectangular members may be telescopic both in length and in width. The collapsible leg means may also be stored inside a side enclosure provided on an outside side of one of the two sheet members.

Preferably, the case also comprises means to hold down the plan well supported on the sheet members. These means may comprise at least one sliding transparent strip extending substantially parallel to the hinge means and being slidable along a groove provided in an edge of the sheet members at each end of the transparent strip.

BRIEF DESCRIPTION OF THE DRAWINGS

The invention will be better understood by way of the following detailed description of two preferred embodiments with reference to the appended drawings in which.

DETAILED DESCRIPTION OF THE PREFERRED EMBODIMENT

Figure 1:
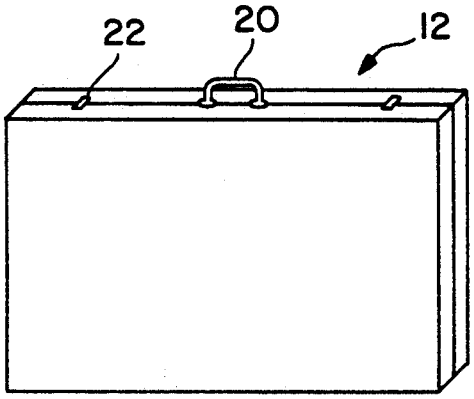
FIG. 1 is an oblique view of the foldable plan stand case according to the first preferred embodiment when closed up.
Figure 2:
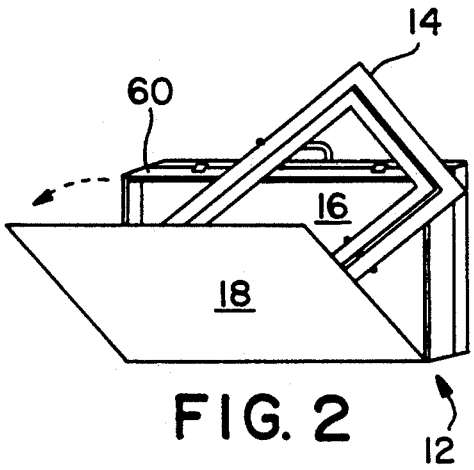
FIG. 2 is an oblique view of the first preferred embodiment with the side panel open and the leg means being removed from the side compartment.
Figure 3:
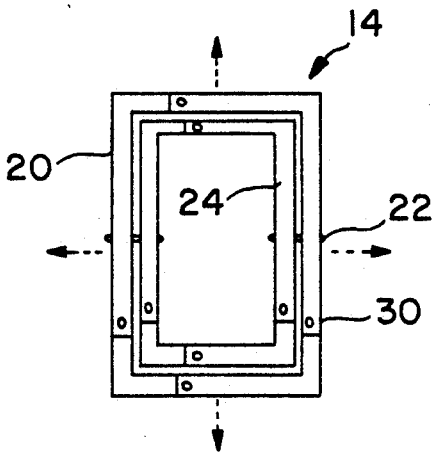
FIG. 3 shows a plan view of the leg means before telescopic expansion and pivoting to form an X-shaped stand.
Figure 4:
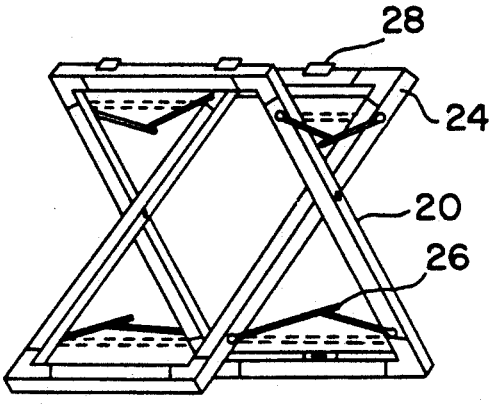
FIG. 4 is an oblique view of the collapsible leg means being opened up.

As shown in FIGS. 1 through 6, the foldable plan stand case (12) according to the first preferred embodiment is used by releasing a plurality of fasteners (34) which may comprise snaps, hook and loop syle fabric fasteners or any other suitable form of fasteners to open side panel (18), and by then removing leg means (14) from the compartment (16) of case (12). As shown in FIG. 3, the leg means (14) comprise two rectangular tubular members (20) and (24) with tubular members (24) being inset inside tubular members (20) and being pivotable by hinge pins (22). The tubular members (20) and (24) are telescopic and are expanded in length and width until resilient locking members immerge through holes (30) provided in larger diameter ones of the tubes forming each of the tubular members (20) and (24).

Figure 5:
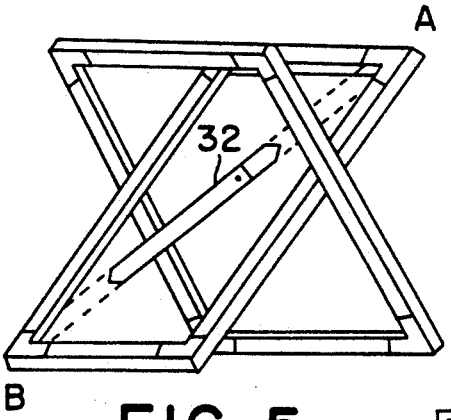
FIG. 5 and FIG. 5*a* shows the collapsible leg means provided with a diagonal brace.
Figure 6:
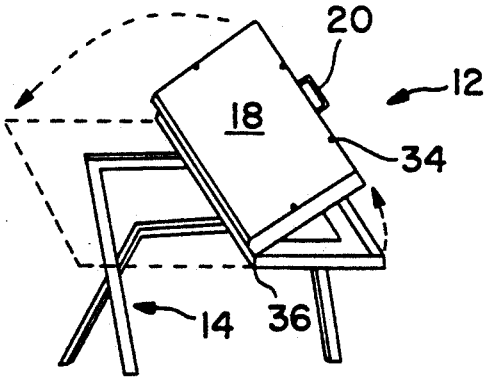
FIG. 6 shows an oblique view of the case according to the first preferred embodiment being opened on the X-shaped stand.
Figure 5A:
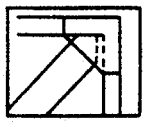

The leg means once expanded are pivoted until locking means (26) engage to prevent further pivoting of the tubular members (20) and (24). Rubber pads (28) provided on upper portions of members (20) and (24) serve to grip the underside of the opened case (12). As shown in FIG. 5, a diagonal brace (32) may be added to reinforce rectangular tubular member (24). As shown in FIG. 6, the case (12) is opened up on X-shaped stand (14) with the hinge (36) of case (12) being transverse to the upper portion of leg means (14). Handle (20) may be used to help open up case (12) as shown.

Figure 7:
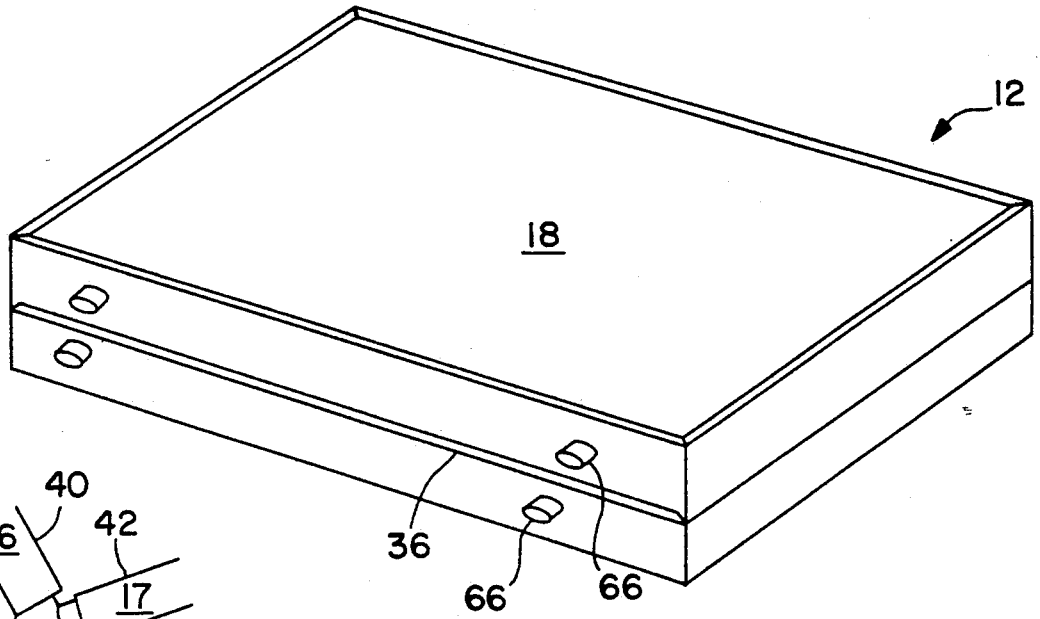
FIG. 7 and FIG. 7*a* is an oblique view of the bottom of the case according to the first preferred embodiment showing also a cross-section detail of the hinge.
Figure 7A:
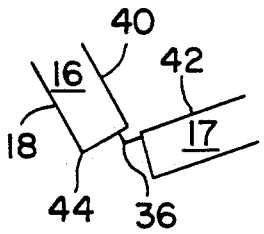

As shown in FIG. 7, the bumper feet (66) of case (12) are offset such that when the case is fully opened, the bumper feet (66) press against opposing sides of the bottom of the case to prevent further pivoting about hinge (36). In this way, the inside plan supporting sheet members (40) and (42) are in line and provide a substantially flat surface when fully opened.

Figure 8:
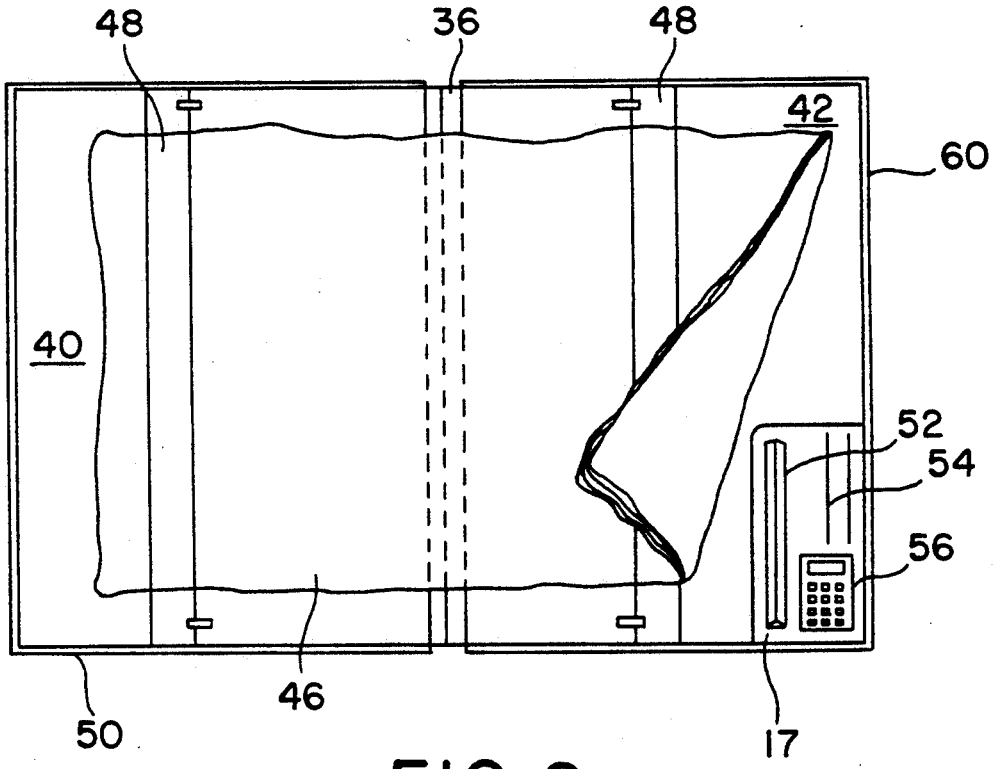
FIG. 8 is a plan view of the case according to the first preferred embodiment as opened up.

As shown in FIG. 8, a set of plans (46) are supported on the sheet members (40) and (42) as well as hinge (36). A pair of transparent strips (48) are provided which cross the sheet members (40) and (42) in a same direction as the hinge (36). The strips (48) fit into grooves provided in edges (50). There is also shown a compartment inside cavity (17) for storing a ruler (52), pencils (54) and a calculator (56). Although access to the compartment in cavity (17) is shown as being from through the surface of sheet member (42), it is of course possible to provide access through side (60) or (50) or even (18).

Figure 9:
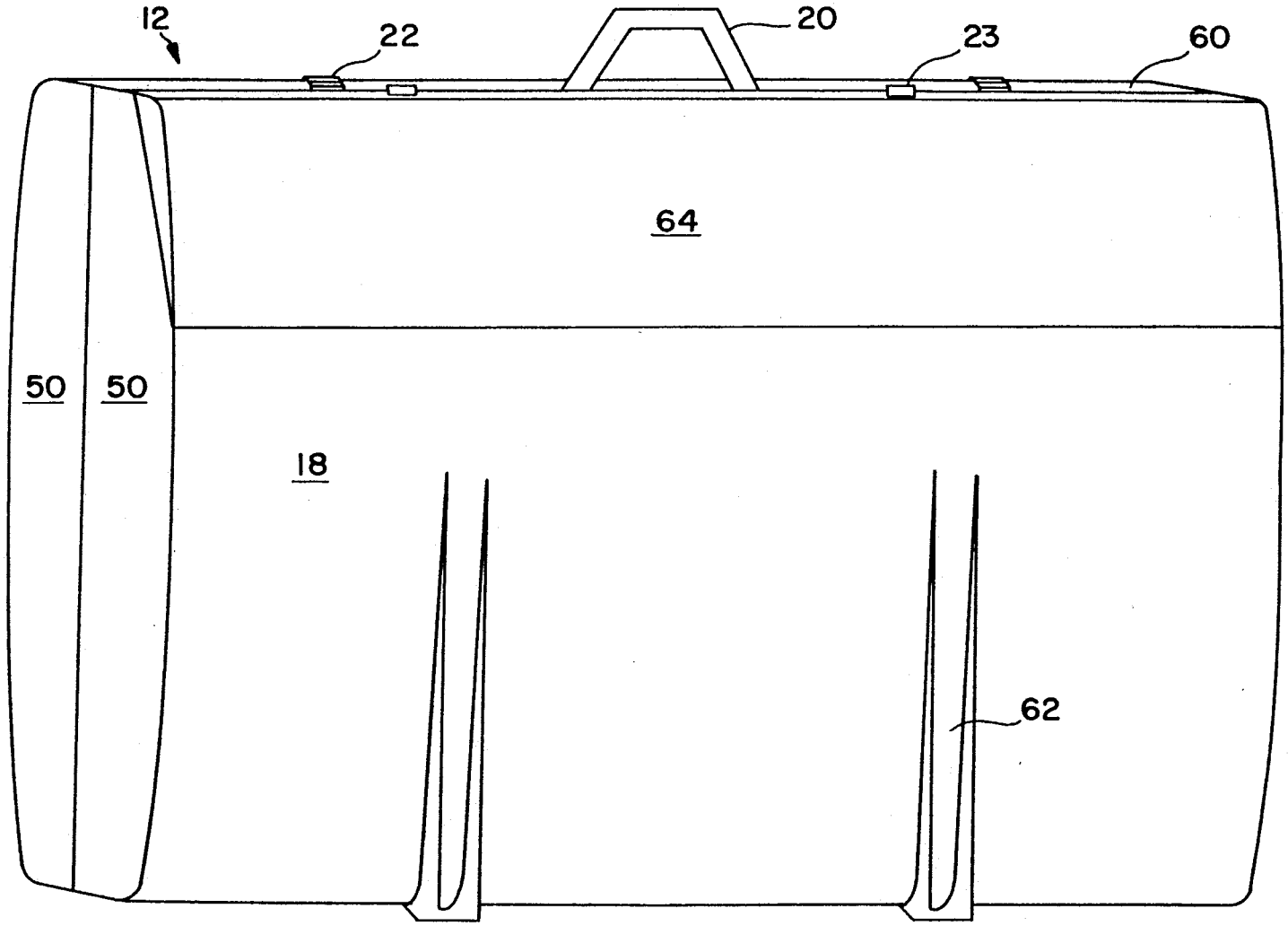
FIG. 9 is an oblique side view of the case according to the second preferred embodiment when closed up.
Figure 10:
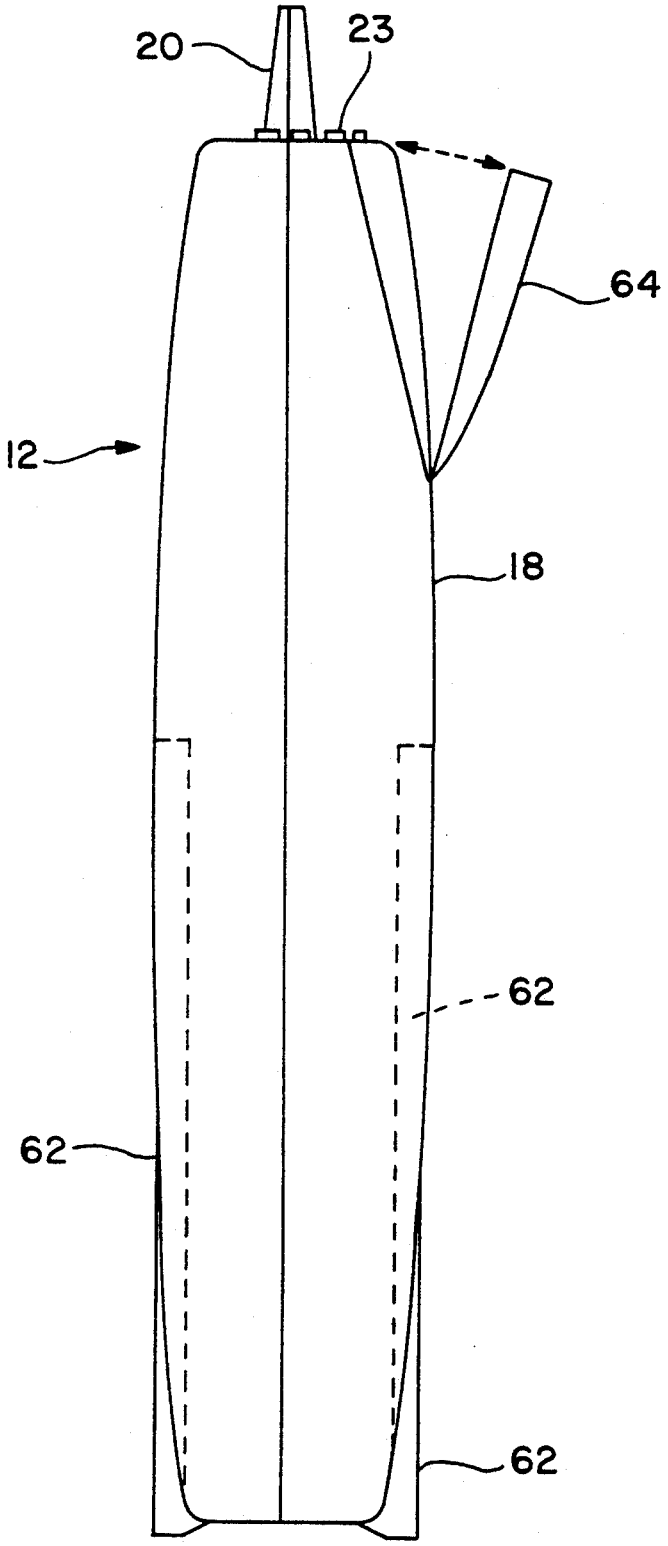
FIG. 10 shows an end view of the case according to the second preferred embodiment.

In the second preferred embodiment, as shown in FIG. 9, the case (12) is provided with an access door (64) articulated to panel (18) to provide access to cavity (16) in which the leg means are to be stored. In the second preferred embodiment locking clasps (22) are provided to close up case (12) and clasps (23) are provided to close up panel (64). Special grooves (62) are provided on the sides of case (12) in order to fit the upper portions of the leg means. As shown in FIG. 10, the bottom of the case (12) is so formed that the ends of grooves (42) act as feet for the case and will abut one against the other to prevent the case from opening more than 180 degrees.

What is claimed is:

1. A foldable plan stand case comprising:

two plan supporting sheet members;

hinge means pivotally connecting said sheet members together, such that said sheet members and said hinge means form a substantially flat surface when said sheet members are pivoted to be in line with one another and in an open position;

detachable leg means for supporting said sheet members in said open position, and means for storing said leg means when said leg means are detached and said sheet members are closed up.

2. The case as claimed in claim 1, wherein said leg means are collapsable.

3. The case as claimed in claim 2, wherein said leg means comprise a pair of tubular rectangular members, a first one of said pair of tubular rectangular members being inset inside a second one of said pair of tubular rectangular members, each one of said pair of tubular rectangular members being telescopic both in length and width and being pivotally joined to form an X-shaped stand, and means being provided to lock said rectangular members in said X-shaped stand formation.

4. The case as claimed in claim 3, further comprising rubber pads provided on upper portions of said two tubular members, said upper portions of said tubular members being transverse to said hinge means.

5. The case as claimed in claim 1, wherein said storing means comprise a side enclosure provided on an outside side of one of said two sheet members.

6. The case as claimed in claim 3, wherein said storing means comprise a side enclosure provided on an outside side of one of said two sheet members.

7. The case as claimed in claim 1, wherein said hinge means comprise a "piano" hinge.

8. The case as claimed in claim 1, further comprising border means connected to said sheet members for enclosing a space between said sheet members when closed up.

9. The case as claimed in claim 8, wherein said border means comprise edge strips for said sheet members, said edge strips being substantially perpendicular to each one of said sheet members.

10. The case as claimed in claim 8, further comprising a locking clasp provided between said edge strips.

11. The case as claimed in claim 8, further comprising a handle connected to said border means.

12. The case as claimed in claim 1, further comprising an instrument compartment in said case.

13. The case as claimed in claim 9, wherein at least one of said edge strips is provided around a corresponding one of said sheet members such that a cavity is created under said corresponding one of said sheet members, further comprising an instrument compartment in said cavity.

14. The case as claimed in claim 1, further comprising means to hold down said plan while supported on said sheet members.

15. The case as claimed in claim 14, wherein said means to hold down said plan comprise at least one sliding transparent strip extending substantially parallel to said hinge means and being slidable along a groove provided in an edge of said sheet members engaged by each end of said transparent strip.

16. The case as claimed in claim 1, further comprising a handle connected to one of said sheet members.

17. The case as claimed in claim 1, further comprising locking means for securing said sheet members when closed up.

* * * * *